US006250973B1

(12) United States Patent
Lowery et al.

(10) Patent No.: US 6,250,973 B1
(45) **Date of Patent: *Jun. 26, 2001**

(54) TWO CONDUCTOR SPLIT RING BATTERY POST CONNECTOR

(75) Inventors: Vernon Lowery; Dylan T. Gordy, both of Brandon, MS (US)

(73) Assignee: Multicraft International, Brandon, MS (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/257,527

(22) Filed: Feb. 25, 1999

(51) Int. Cl.[7] ..... H01R 4/42
(52) U.S. Cl. ..... 439/763
(58) Field of Search ..... 439/764, 772, 439/770, 762, 763, 759, 522

(56) References Cited

U.S. PATENT DOCUMENTS

| | | | | |
|---|---|---|---|---|
| 5,316,505 | * | 5/1994 | Kipp | 439/764 |
| 5,773,152 | * | 3/1998 | Freitag | 439/763 |
| 5,800,219 | * | 9/1998 | Siedlik et al. | 439/762 |
| 5,879,202 | * | 3/1999 | Zhao | 439/762 |
| 5,980,334 | * | 11/1999 | Pyles | 439/764 |

* cited by examiner

*Primary Examiner*—Khiem Nguyen
*Assistant Examiner*—J. F. Duverne
(74) *Attorney, Agent, or Firm*—Blank Rome Comisky & McCauley LLP

(57) ABSTRACT

A battery connector connects two wires to a battery post. The battery connector includes two identically formed L-shaped conductors electrically insulated from one another by an insulator. Each of the conductors comprises a split ring portion for making good mechanical and electrical contact with a battery post and a crimping portion for electrically connecting a wire to the conductor. The conductors and insulator are assembled and held together by cooperating and mating components.

38 Claims, 2 Drawing Sheets

TWO CONDUCTOR SPLIT RING BATTERY POST CONNECTOR

FIELD OF THE INVENTION

The present invention is directed to a battery post connector and more particularly to a battery post connector for use in a motor vehicle for connecting two wires to a battery post of the vehicle battery so that the wires can be kept physically separated from each other to reduce RFI emissions from the wires.

DESCRIPTION OF RELATED ART

In some arts, such as that of automotive electrical systems, it is sometimes required to connect two wires (cables, etc.) to the same battery post. For example, if an automobile alternator is connected to the battery in parallel with the rest of the electrical system, the positive post of the battery will be connected to the alternator output and to other components such as the starter, while the negative post of the battery will be connected to the alternator enable and to a ground, such as the engine block.

In such cases, it is conventional to connect two wires to a common terminal that is then connected to the battery post. However, the use of the conventional common terminal causes problems, such as RFI (radio frequency interference) emissions.

SUMMARY OF THE INVENTION

In view of the foregoing, it should be apparent that there still exists a need in the art for a connector device for connecting multiple wires to a battery terminal while minimizing RFI emissions. It is therefore a primary objective of the present invention to electrically connect two wires to a battery post without using a common terminal, or in other words, without electrically connecting the wires to one another except through the battery post itself.

It is another object of the present invention to connect two wires to a battery post through conductors that are sized and positioned to limit the amount of current passing through any one of the wires at a given time, thus reducing the RFI emissions that the wires can conduct.

It is still another object of the present invention to connect two or more wires to a battery post through conductors that are insulated from one another so as to hold the wires in such a way as to preclude inadvertent shorting.

Yet another object of the invention is to provide a battery post connector for two wires that is compact and inexpensive to manufacture.

A further objective of the invention is to simplify the design of a two conductor battery terminal connector for ease of assembly and use.

Another object of the invention is to provide a two conductor battery post connector in which the two conductors are an identical design suitable for sheet metal stamping.

To achieve these and other objects, the present invention is directed to a battery terminal for connection to a battery post, the battery terminal comprising two identical conductors separated by an insulator. Each of the conductors makes electrical contact with the battery post, but not with the other conductor, and includes a crimp terminal or the like for connecting the conductor to one of the wires.

BRIEF DESCRIPTION OF THE DRAWINGS

Preferred embodiments of the present invention are set forth in detail hereinafter with reference to the drawings, in which.

DETAILED DESCRIPTION OF THE PREFERRED EMBODIMENTS

Figure 1:
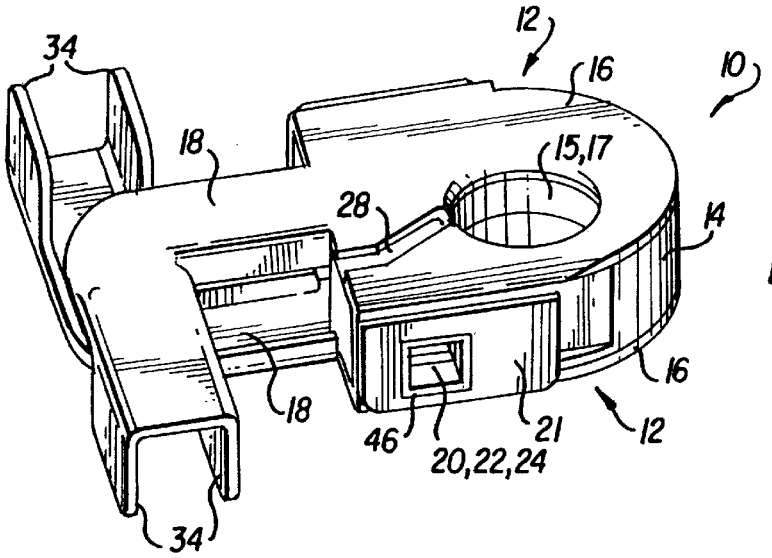
FIG. 1 is a perspective view of a terminal connector made according to a preferred embodiment of the present invention suitable for mounting on a battery post.

FIG. 1 illustrates in perspective a fully assembled two conductor battery terminal or post connector according to the invention which is designated generally by reference numeral 10. The connector 10 is designed for use on a smooth wall battery post, although it could easily be adapted for use with other kinds of posts, such as, for example, a threaded battery post. The connector 10 comprises three main components, a pair of identically formed conductors 12 connected together but electrically insulated from one another by means of an insulator 14 with a central opening 15 therein.

Figure 2:
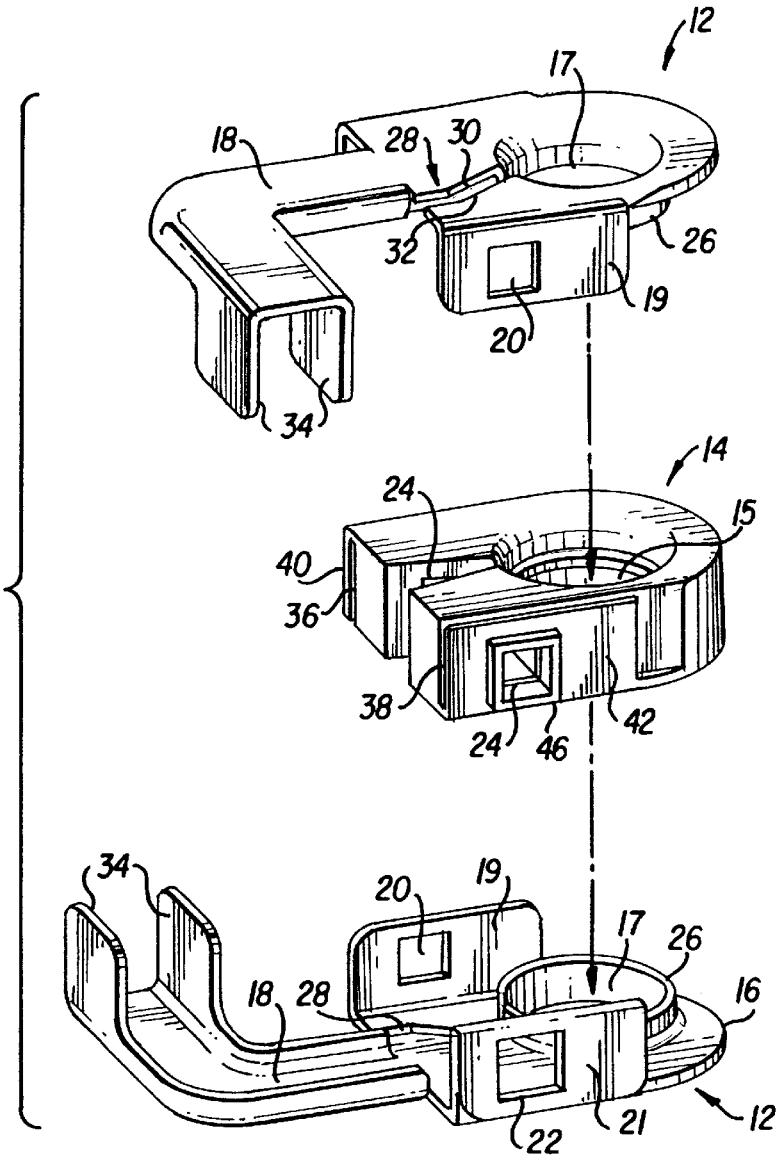
FIG. 2 is an exploded perspective view of the terminal connector of FIG. 1 showing the three components of the connector.

Referring also to FIG. 2, each conductor 12 is formed from an electrically conductive sheet metal, such as steel or a steel alloy, and comprises generally a split ring portion 16 with an opening 17 aligned with the central opening 15 of the insulator 14. Each conductor is integrally formed in one piece with an L-shaped wire crimping portion 18 generally coplanar with the split ring portion 16 and a pair of depending tabs 19, 21. The insulator 14 is disposed between the two split ring portions of the conductors 12 so as to electrically insulate them from one another as described in more detail hereinafter. The insulator 14 may be made of any suitable electrically insulative material such as a relatively flexible molded plastic or composite material.

In the assembled condition shown in FIG. 1, the connector 10 may be disposed over a battery post or terminal (not shown) with the post or terminal extending through the openings 15, 17 in the insulator 14 and conductors 12. The openings 17 in the split ring portions 16 of the conductors are sized to form a loose fit with the battery post. The opening 15 in the insulator 14 is larger in diameter than the openings 17 and the battery post so as to have a substantial annular space between the insulator 14 and the peripheral surface of the post. In this way the connector 10 may be easily positioned over the battery post without the need to apply force. Once the connector 10 is positioned over the post, a fastener, such as a conventional threaded bolt (not shown), is passed through square or polygonal openings 20, 22 in the depending tabs 19, 21, respectively, of the conductors 12 and polygonal openings 24 in the insulator 14, and a nut (not shown) is threaded onto the bolt and tightened so as to force the split ring portions 16 of the conductors into tightly gripping engagement with the battery post to thereby make good electrical contact between the conductors and the post.

To facilitate the connection to a battery post and to enlarge the contact area between the conductor and the post, the split ring portions 16 are drawn down around the openings 17 to form short tubular sections 26 which fit into the opening 15 of the insulator 14. The confronting ends of the tubular sections 26 are spaced from one another when assembled as in FIG. 1 so as not to make electrical contact and short the conductors. The split ring portions 16 are formed with a gap 28 with confronting edges 30, 32 spaced from one another to allow the clamping action of the bolt to cause the split ring portions to firmly grip and make good electrical contact with the post.

The crimping portion 18 of each connector 12 is provided with a pair of depending ears 34 which are adapted to be bent over to crimp an electrical conductor such as a stranded wire or cable (not shown) to the L-shaped crimping portion. The crimping portions 18 are advantageously L-shaped so that the wires connected thereto are oriented in opposite directions from the connector 10 to avoid contact and shorting between the wires as best seen in FIG. 1.

Connector 10 can be used on both posts or terminals of an automobile battery. For example, the positive post can be connected through one crimping portion 18 to the PDB (power distribution box) and the starter and through the other crimping portion 18 to the alternator output. Similarly, the negative post can be connected through one crimping portion 18 to the alternator enable and through the other crimping portion 18 to an appropriate ground such as the engine block or the sheet metal of the automobile.

Figure 3:
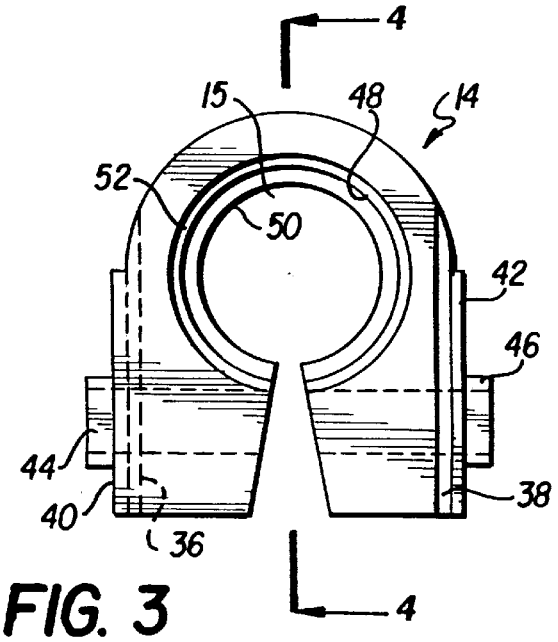
FIG. 3 is a top plan view of the insulator component of the connector of FIGS. 1 and 2.
Figure 4:
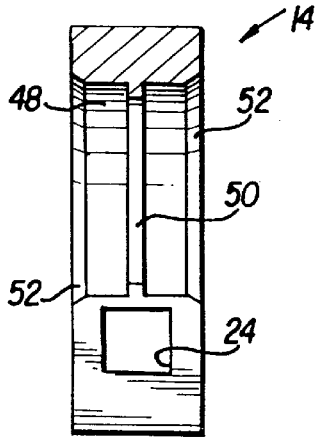
FIG. 4 is a cross-sectional view of the insulator of the connector taken along line 4—4 of FIG. 3.
Figure 5:
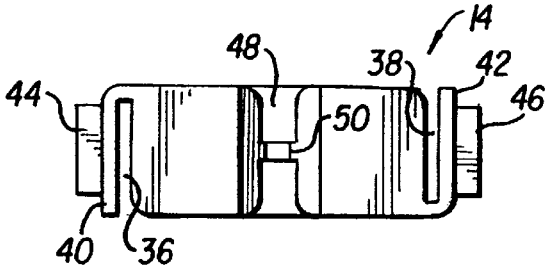
FIG. 5 is an end view of the insulator of FIG. 3.

Referring now to FIGS. 3–5, the construction of the insulator will be described in more detail. The insulator 14 is preferably molded of a resilient composite plastic material in a split ring configuration. As best seen in FIG. 5, the insulator is molded with a pair of oppositely directed channels or slots 36, 38 in which a respective depending tab 19 of the two conductors 12 are disposed. The slots 36, 38 also form flat insulator plates 40, 42 on opposite sides of the insulator 14. Polygonal (square) projecting rims 44, 46 are molded on the exterior surfaces of the insulator plates 40, 42. The other two depending tabs 21 of the conductors 12 are located outside the plates 40, 42 with the square rims 44, 46 extending through a respective hole 22 of each tab 21. The insulator plates 40, 42 thus provide electrical insulation between the respective tabs 19 and 21 of the opposed conductors and the rims 44, 46 hold the two conductors 12 and insulator 14 together in assembled relation so that a bolt may be inserted into the holes 20, 22, 24.

The opening 15 of the insulator 14 comprises a bore 48 that may be provided with an annular bead or shoulder 50 that provides an insulator between the confronting ends of the tubular sections 26 of the split ring portions 18. Bore 48 is preferably chamfered on both ends as at 52 to better accommodate the drawn down tubular sections 26.

Figure 6:
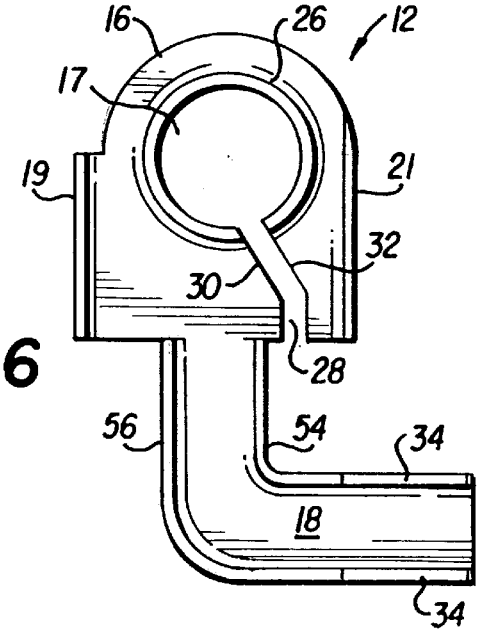
FIG. 6 is a plan view of a conductor of the battery post connector of the present invention.
Figure 7:
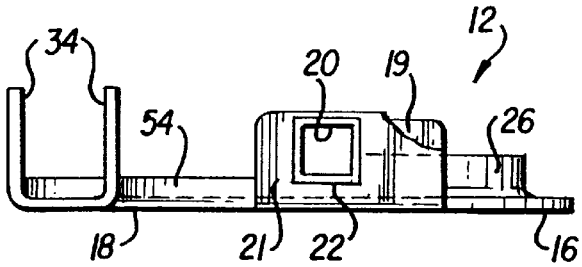
FIG. 7 is a side elevation view of the conductor of FIG. 6.

Now referring to FIGS. 6 and 7, the conductor 12 is shown in detail. The gap 28 is formed in two sections angled to one another with sufficient space between the confronting edges 30, 32 to provide good gripping mechanical and electrical contact between the conductor and a battery post. For strength purposes, the L-shaped crimping portion 18 is provided with upturned edges 54, 56. As best seen in FIG. 7, the insulator plate 19 has a slightly shorter height than the insulator plate 21 so as to fit completely into the slot or channel 36 or 38. The opening 22 is also larger than the opening 20 to accommodate the rims 44, 46.

It will be appreciated by those skilled in the art that the present invention provides a two conductor battery connector of a simple, yet effective and durable construction that can be assembled and held together without the need for a fastener until the connector is attached to a battery post. The three components of the connector are readily formed by two sheet metal stampings and a molding and the L-shaped design of the stampings advantageously avoid inadvertent shorts between the conductors.

While the preferred embodiment of the present invention has been set forth above, those skilled in the art who have reviewed the present disclosure will readily appreciate that other embodiments can be realized within the scope of the invention. For example, while the preferred embodiments have been disclosed as connecting wires to a battery terminal, the wires can be replaced with any other suitable conductors, such as cables. In particular, it will be understood that the term "wires" is broad enough to encompass cables and the like. Therefore, the present invention should be construed as limited only by the appended claims.

We claim:

1. A connector for electrically connecting a plurality of wires to a battery post, the connector comprising:

a plurality of conductors each comprising:

a split ring portion having a conducting surface for electrically contacting the post; and a crimping portion for electrically connecting the conductor to one of the plurality of wires;

an insulator disposed between the conductors for electrically insulating the conductors from one another; and a single fastener for urging the split ring portions into gripping mechanical and electrical contact with the battery post.

2. The connector of claim 1, wherein the conductor comprises an L-shaped metal stamping.

3. The connector of claim 1, wherein the conductors are formed identically to one another.

4. The connector of claim 1, wherein the insulator is formed as a split ring.

5. The connector of claim 1, including two conductors, the split ring portion of each conductor including first and second depending tabs, the insulator having a pair of channels on opposite sides thereof for receiving the first depending tab of each conductor.

6. The connector of claim 5, wherein the channels of the insulator define a pair of insulator plates, the second depending tab of each conductor being insulated from the first depending tab of the other conductor by a respective one of said plates.

7. The connector of claim 6, including a projecting rim on each of said insulator plates, the second depending tab of each conductor having an opening adapted to fit around the projecting rim of a respective plate.

8. The connector of claim 1, wherein said insulator has a central bore and said split ring portion of each conductor has a tubular section, the tubular section of each split ring portion extending into the central bore of the insulator.

9. The connector of claim 8, wherein said central bore has an annular shoulder, the tubular section of each conductor being insulated from the other by said annular shoulder.

10. The connector of claim 5, wherein the depending tabs of each conductor have openings through which the fastener is adapted to extend for urging the split ring portions into mechanical and electrical contact with the battery post.

11. The connector of claim 10, wherein the openings are square in shape.

12. The connector of claim 11, wherein the opening in the first depending tab is smaller than the opening in the second depending tab.

13. The connector of claim 5, wherein the two conductors have essentially identical shapes, and one conductor is inverted relative to the other conductor.

14. The connector of claim 1, wherein the crimping portion has a pair of depending ears adapted to be bent over to grip and make electrical contact with a wire.

15. A connector for electrically connecting a plurality of wires to a battery post, the connector comprising:

a plurality of conductors each comprising:

a split ring portion formed from a sheet metal stamping having a conducting surface for electrically contacting the post and first and second depending tabs; and a crimping portion for electrically connecting the conductor to one of the plurality of wires;

an insulator diposed between the conductors for electrically insulating the conductors from one another, the insulator having a pair of channels on opposite sides thereof for recieving the first depending tab of each conductor; and a fastener for urging the stamped split ring portions into gripping mechanical and electrical contact with the battery post.

16. The connector of claim 15, wherein the conductors are formed identically to one another.

17. The connector of claim 15, wherein the channels of the insulator define a pair of insulator plates, the second depending tab of each conductor being insulated from the first depending tab of the other conductor by a respective one of said plates.

18. The connector of claim 17, including a projecting rim on each of said insulator plates, the second depending tab of each conductor having an opening adapted to fit around the projecting rim of a respective plate.

19. The connector of claim 15, wherein the depending tabs of each conductor have openings through which the fastener is adapted to extend for urging the split ring portions into mechanical and electrical contact with the battery post.

20. The connector of claim 19, wherein the openings are square in shape.

21. The connector of claim 20, wherein the opening in the first depending tab is smaller than the opening in the second depending tab.

22. The connector of claim 15, wherein the two conductors have essentially identical shapes, and one conductor is inverted relative to the other conductor.

23. A connector for electrically connecting a plurality of wires to a battery post, the connector comprising:

a plurality of conductors each comprising:

a split ring portion formed from a sheet metal stamping having a conducting surface for electrically contacting the post, the split ring portion having a tubular section; and a crimping portion for electrically connecting the conductor to one of the plurality of wires;

an insulator disposed between the conductors for electrically insulating the conductors from one another, the insulator having a central bore for recieving the tubular section of each split ring portion; and a fastener for urging the stamped split ring portions into gripping mechanical and electrical contact with the battery post.

24. The connector of claim 23, wherein the conductors are formed identically to one another.

25. The connector of claim 23, wherein said central bore has annular shoulder, the tubular section of each conductor being insulated from the other by said annular shoulder.

26. A connector for electrically connecting two wires to a battery post, the connector comprising:

a first conductor having a conducting surface for electrically contacting the post, a first depending tab, and a first crimping portion for electrically connecting the first conductor to one of the two wires;

a second conductor having a conducting surface for electrically contacting the post, a second depending tab, and a second crimping portion for electrically connecting the second conductor to the other of the two wires, wherein the second depending tab of the second conductor overlaps the first depending tab of the first conductor; and an insulator disposed between said first conductor and said second conductor for electrically insulating said first and second conductors from one another.

27. The connector of claim 26, said first conductor having a first split ring portion and said second conductor having a second split ring portion, and a fastener for urging the first and second split ring portions into gripping mechanical and electrical contact with the battery post.

28. The connector of claim 27, wherein the first and second depending tabs have openings through which the fastener is adapted to extend for urging the split ring portions into mechanical and electrical contact with the battery post.

29. The connector of claim 28, wherein the openings are square in shape.

30. The connector of claim 26, wherein the first and second depending tabs extend substantially perpendicular to a main portion of the first and second conductors, respectively.

31. The connector of claim 26, wherein the first and second conductors are formed identically to one another.

32. The connector of claim 26, wherein the first and second conductors and the insulator are each formed as split rings.

33. The connector of claim 26, wherein said insulator has a central bore and the first and second conductors each have a tubular section, the tubular section of each conductor extending into the central bore of the insulator.

34. The connector of claim 33, wherein said central bore has an annular shoulder, the tubulr section of the first and second conductors being insulated from the other by said annular shoulder.

35. The connector of claim 26, wherein the two conductors have essentially identical shapes, and one conductor is inverted relative to the other conductor.

36. The connector of claim 26, further comprising a first and second channel on opposite sides of the insulator, the first channel recieving the first depending tab and the second channel receiving the second depending tab.

37. The connector of claim 36, said first conductor having a third depending tab and said second conductor having a fourth depending tab.

38. The connector of claim 37, wherein the first and second channels each define an insulating plate, the first and second depending tabs and the third and fourth depending tabs being insulated from each other by a respective one of the insulating plates.

* * * * *